US008692670B2

(12) United States Patent
Hart et al.

(10) Patent No.: US 8,692,670 B2
(45) Date of Patent: Apr. 8, 2014

(54) SECURITY SYSTEM

(75) Inventors: Nigel Hart, Locksbottom (GB); Jason Brown, Locksbottom (GB)

(73) Assignee: Selectamark Security Systems PLC, Locksbottom Kent (GB)

( * ) Notice: Subject to any disclaimer, the term of this patent is extended or adjusted under 35 U.S.C. 154(b) by 576 days.

(21) Appl. No.: 12/921,861

(22) PCT Filed: Mar. 11, 2009

(86) PCT No.: PCT/EP2009/052827

§ 371 (c)(1),
(2), (4) Date: Nov. 5, 2010

(87) PCT Pub. No.: WO2009/112507

PCT Pub. Date: Sep. 17, 2009

(65) Prior Publication Data

US 2011/0050418 A1 Mar. 3, 2011

(30) Foreign Application Priority Data

Mar. 11, 2008 (GB) ..... 0804493.5

(51) Int. Cl.
*G08B 13/00* (2006.01)

(52) U.S. Cl.
USPC ..... 340/541; 340/506; 340/539.1; 340/545.3

(58) Field of Classification Search
USPC ..... 340/541, 506, 539.1, 539.22, 531, 340/426.26, 825.69, 825.72, 573.1; 109/20, 109/29, 30, 31; 250/338.1, 339.02
See application file for complete search history.

(56) References Cited

U.S. PATENT DOCUMENTS

| | | | | |
|---|---|---|---|---|
| 4,698,620 | A * | 10/1987 | Marshall | 340/568.2 |
| 5,402,000 | A | 3/1995 | Owens et al. | |
| 6,094,135 | A * | 7/2000 | Sugimoto et al. | 340/541 |
| 6,696,928 | B1 * | 2/2004 | Boveja et al. | 340/426.12 |
| 7,388,485 | B1 * | 6/2008 | Shen | 340/541 |
| 2005/0073404 | A1 | 4/2005 | Hisano et al. | |
| 2010/0265066 | A1 * | 10/2010 | Edelman | 340/541 |

FOREIGN PATENT DOCUMENTS

| | | | |
|---|---|---|---|
| EP | 0137708 | A2 | 4/1985 |
| FR | 2716026 | A | 8/1995 |
| FR | 2769738 | A | 4/1999 |

OTHER PUBLICATIONS

Pullen, Joanne, Combined Search and Examination Report under Sections 17 & 18(3), UK Intellectual Property Office, Application No. GB0804493.5, Jul. 10, 2008.
Michotte, Tanguy, International Search Report, European Patent Office, PCT/US09/052827, May 28, 2009.

* cited by examiner

*Primary Examiner* — Hung T. Nguyen
(74) *Attorney, Agent, or Firm* — Joseph R. Baker, Jr.; Gavrilovich, Dodd & Lindsey LLP

(57) ABSTRACT

A security system comprising: a controller; and a plurality of dispensing devices, wherein the controller is configured to receive signals from a plurality of remote detectors and transmit signals to the plurality of dispensing devices, the controller being adapted to determine which of the plurality of detectors has transmitted a signal and transmit a signal to a selected one or more dispensing devices to dispense a fluid based on said determination, wherein each dispensing device is configured to receive signals from the controller and dispense fluid when a signal is received.

9 Claims, 3 Drawing Sheets

SECURITY SYSTEM

CROSS REFERENCE TO RELATED APPLICATIONS

This application is a U.S. National Stage Application filed under 35 U.S.C. §371 and claims priority to International Application No. PCT/EP2009/052827, filed Mar. 11, 2009, which application claims priority to Great Britain Application No. 0804493.5, filed on Mar. 11, 2008, the disclosure of which are incorporated herein by reference.

FIELD OF INVENTION

The present invention relates to a security system. Particular embodiments are for use in buildings at entry points such as doors and windows. Embodiments of the present invention are particularly concerned with security systems which dispense a fluid for deterring and/or identifying an intruder.

BACKGROUND OF THE INVENTION

Alarm systems which dispense a fluid in order to deter and/or identify an attacker or intruder are known in the art. One type of such a system is a personal handheld alarm which can be activated by a user in order to spray an attacker with a fluid such a chemical irritant and/or an identifier such as a DNA identifier comprising a unique DNA code combined with an ultraviolet identifier spray. An example of such a personal alarm is described in GB 2,321,995. An example of a DNA identifier formulation is given in GB 2,439,960.

It is also known in the art to incorporate fluid dispensing alarm systems into building security systems at entry doors. U.S. Pat. No. 4,062,303, WO 00/73609 and WO 03/016663 disclose examples of such security systems where a dispensing device is mounted on a door frame and is mechanically actuated when the door is forced open in order to dispense a fluid into the doorway. U.S. Pat. No. 5,402,000 discloses a similar security system but with the dispensing unit disposed on a ceiling of a room in such a way that it is directed towards an entry door. The system described in U.S. Pat. No. 5,402,000 works in a similar manner as the previously described systems. When a door is forced open an actuation signal is transmitted to a spraying unit in order to actuate dispensing of a fluid. It is described that the actuation signal can be transmitted by mechanical, electrical, electronic, light, magnetic or gaseous means in working relationship with closure and entry ways.

It is an aim of the present invention to provide an improved security system for use in buildings having a plurality of entry points.

SUMMARY OF THE INVENTION

All the aforementioned arrangements comprise the common features of a means of detecting a door being forced open, a means of transmitting this detection directly to a dispensing device, and a dispensing device for dispensing the fluid into the doorway.

The present applicant has realised that for a building comprising a plurality of entry points, utilising the security systems described in the previously referenced prior art would involve installing a complete system at each entry point. Each of these systems comprises a complicated actuation mechanism or electrical system for controlling the dispensing device when its associated entry point is activated. As such, for buildings having a plurality of entry points, the cost of protecting all the entry points would become large.

Another problem which the present applicant has identified is that each of the systems described in the prior art requires activation or deactivation as desired at each entry point.

Another problem which the present applicant has identified is that the previously described security systems cannot easily be integrated into existing security systems which may already be installed in a building.

In light of the above, and in accordance with a first aspect of the present invention there is provided a security system comprising: a controller; and a plurality of dispensing devices, wherein the controller is configured to receive signals from a plurality of remote detectors and transmit signals to the plurality of dispensing devices, the controller being adapted to determine which of the plurality of detectors has transmitted a signal and transmit a signal to a selected one or more dispensing devices to dispense a fluid based on said determination, wherein each dispensing device is configured to receive signals from the controller and dispense fluid when a signal is received.

Embodiments of the present invention are specifically adapted for use in buildings which comprise numerous entry points such as doors and windows. Rather than requiring a plurality of separate and distinct systems to be installed at each entry point with their own separate detecting and controlling parts, the present invention centralises control for a plurality of detectors and dispensing units such that the apparatus needed at each entry point can be reduced in complexity and cost. As such, the present system can be installed in a building having a number of entry points with a single central controller for controlling the dispensing units at all entry points allowing a reduction in cost for protecting all the entry points in a building.

A further advantage of embodiments of the present invention is that all the detectors/dispensing devices, or selected ones of the detectors/dispensing devices, can be activated or deactivated as desired from a single location at the central controller.

The detectors may communicate with the central controller via a wireless connection or using wires. Furthermore, the central controller and the dispensing units may communicate via wireless connection or via wires.

Embodiments of the present invention can be integrated into security systems which have already been installed into a building. For example, detectors such as passive infrared (PIR) detectors may already have been installed at entry points in a building for communication with one or more audible alarms. According to certain embodiments of the present invention, the central controller is adapted to communicate with detectors of an already installed system such that further detectors are not required to be installed. A central controller may be adapted to communicate with existing detectors by providing electrical connectors in order to connect to the existing detectors with wiring. Alternatively, the central controller may be adapted so as to be tuneable to communication frequencies of existing detectors such that when the controller is installed into a building it can be tuned to the communication frequencies used by the existing detectors. With such embodiments, separate detectors are not required to be installed thus reducing cost and complexity of installation.

Alternatively, according to other embodiments of the present invention, dedicated detectors can be provided for use in the security system. These dedicated detectors may be provided as separate units or they may be integrated into the dispensing devices.

Preferably, the controller is configured to receive signals from a first plurality of detectors and a second plurality of detectors, wherein when a signal is received from one or more of the first plurality of detectors, the controller arms the system, and when a signal is received from one or more of the second plurality of detectors, the controller determines which of the second plurality of detectors has transmitted the signal and transmits a signal to the one or more dispensing devices to dispense a fluid based on said determination.

This arrangement is advantageous as it prevents false activation of the dispensing devices. The first plurality of detectors can be located at entry points such as doors and windows to detect an intruder forcing entry into the building. These detectors can then signal the central controller to arm the fluid dispensing security system located in the interior of the building. Subsequently, if the intruder is sensed by one of the second plurality of detectors associated with a dispensing device, then the controller is signalled and the armed controller then signals the appropriate dispensing device to dispense fluid. If the system is not armed by a signal from the first plurality of detectors then the controller does not signal the fluid dispensing devices to dispense fluid when a signal is received from one of the second plurality of detectors.

This arrangement prevents a user from accidentally tripping the dispensing system when entering the building. If the system is accidentally armed by such an entry by the user then it may be disarmed by entering a key code or the like at the central controller prior to the user entering a zone covered by the second plurality of detectors and being sprayed with fluid.

The central controller may comprise a processor, at least one receiver, and at least one transmitter. The at least one receiver is adapted to receive signals from the plurality of detectors. The at least one transmitter is adapted to transmit signals to the plurality of remote dispensing devices. The processor is adapted to identify which of the detectors has sent a signal to the central controller and select a dispensing device which is associated with the identified detector in order to signal the appropriate dispensing device to dispense fluid.

The controller may be adapted to select one or more of the plurality of detectors and/or dispensing devices for activation or deactivation. The controller may also be adapted to indicate to the dispensing devices a duration for dispensing fluid. Further still, the controller may be adapted to indicate to the dispensing devices a type of fluid to be dispensed. Different control signals may be sent to different ones of the plurality of dispensing devices from the controller.

Detectors and the dispensing devices can be installed at various locations including external doorways, windows, and internally within a building such as in passageways or internal doorways. Additionally, detectors and dispensing devices may be positioned at specific locations within the building such as in the location of a safe.

The detectors may be PIR sensors, electromechanical devices or any other form of known detector. The detectors may be actuated manually such as by a panic button.

For a better understanding of the present invention and to show how the same may be carried into effect, embodiments of the present invention will now be described by way of example only.

DETAILED DESCRIPTION OF EMBODIMENTS OF THE PRESENT INVENTION

Figure 1:
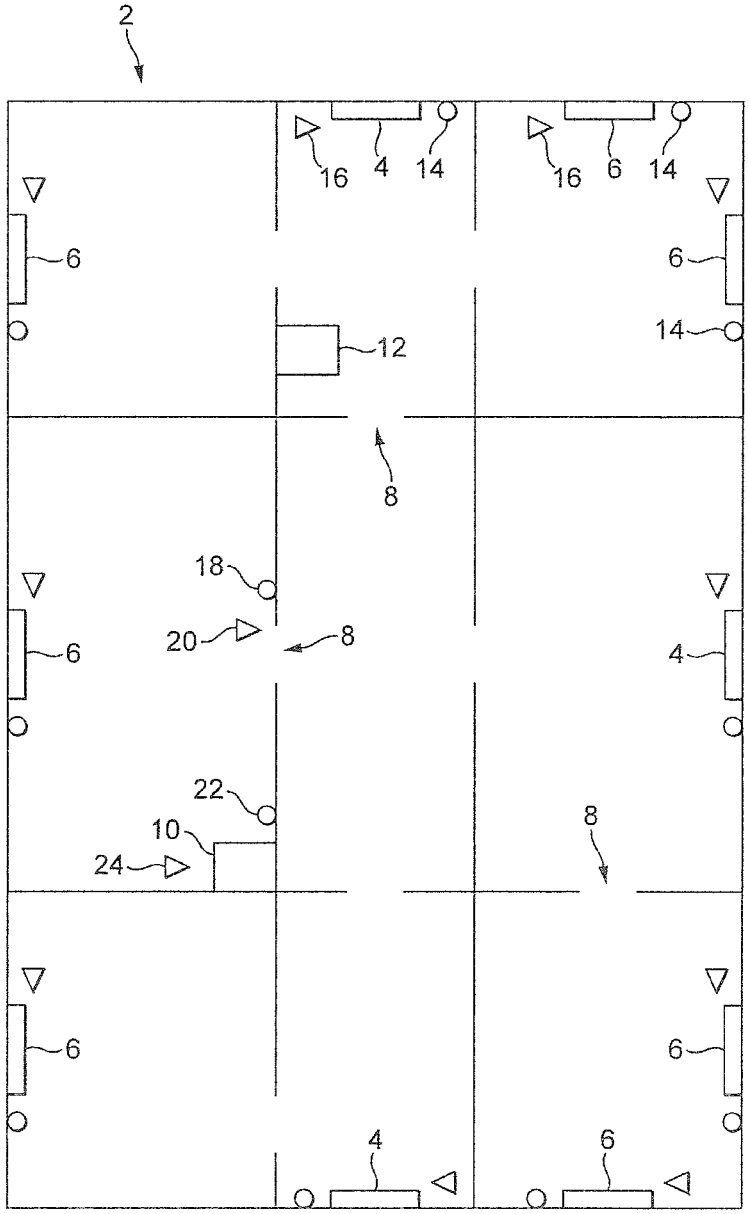
FIG. 1 is a schematic diagram of a security system according to an embodiment of the present invention installed in a building having numerous entry points.

FIG. 1 is a schematic diagram of a security system according to an embodiment of the present invention installed in a building 2 having numerous entry points including doors 4 and windows 6. The building 2 also include internal doorways 8 and has a safe 10 disposed in a corner of one of the rooms.

The system comprises a central controller 12 which is configured to communicate with a plurality of detectors 14 and a plurality of dispensing devices 16. The detectors 14 and dispensing devices 16 are disposed around the building 2 at entry points such as the doors 4 and windows 6. A detector 18 and a dispensing device 20 are also located at an internal doorway 8. A further detector 22 and dispensing device 24 is located in the vicinity of the safe 10. Each of the dispensing devices has an associated detector which may, for example, be a passive infrared sensor.

Figure 2:
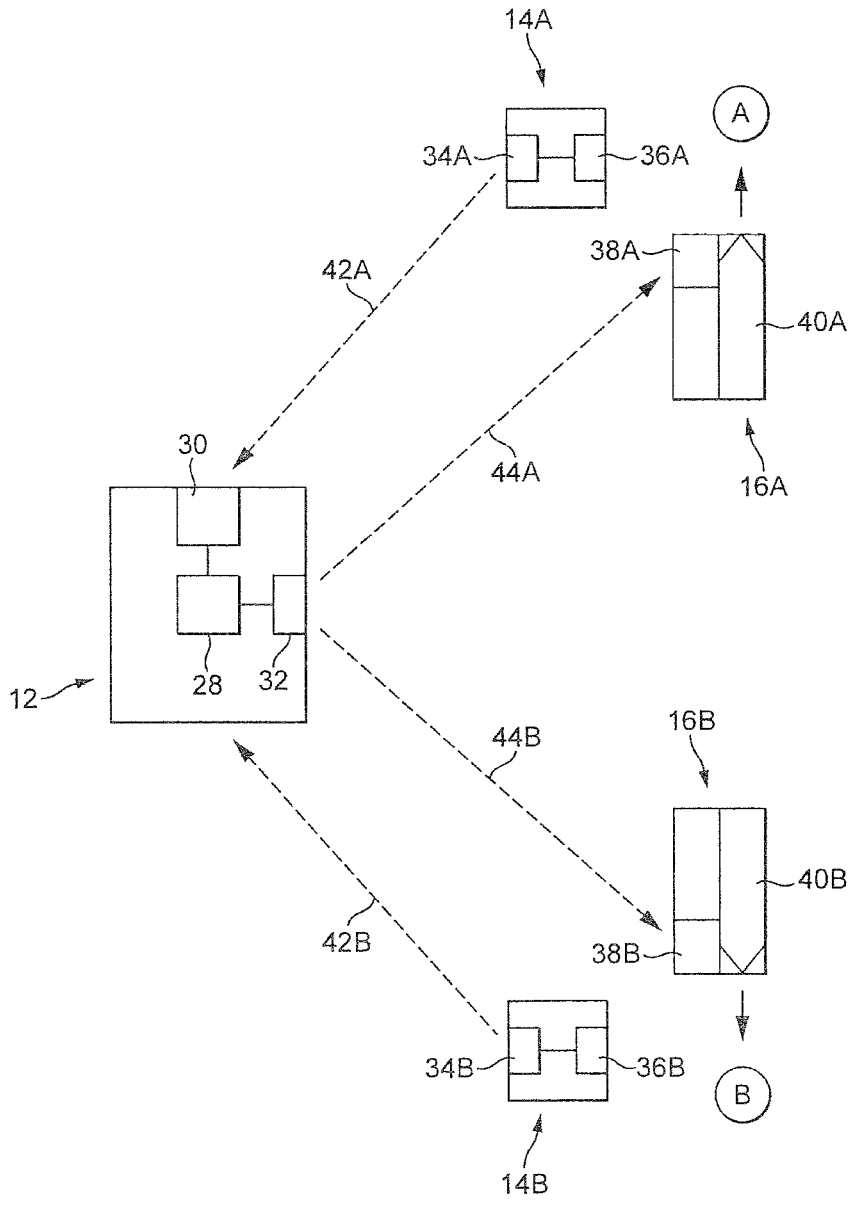
FIG. 2 is a schematic diagram showing a portion of the system of FIG. 1 in more detail.

As illustrated in FIG. 2, the controller 12 comprises a processor 28, a receiver 30, a transmitter 32, the processor 28 being arranged to be in communication with the receiver 30 and the transmitter 32. The detectors 14A, 14B each comprise a transmitting unit 34A, 34B and a detecting unit 36A, 36B. The transmitting units 34A, 34B are adapted to transmit signals to the central controller 12. The detecting units 36A, 36B are adapted to detect an intruder. The dispensing devices 16A, 16B each comprise a receiver 38A, 38B for receiving signals from the central controller and a canister of fluid 40A, 40B arranged to dispense fluid in response to signals transmitted from the central controller 12.

Figure 3:
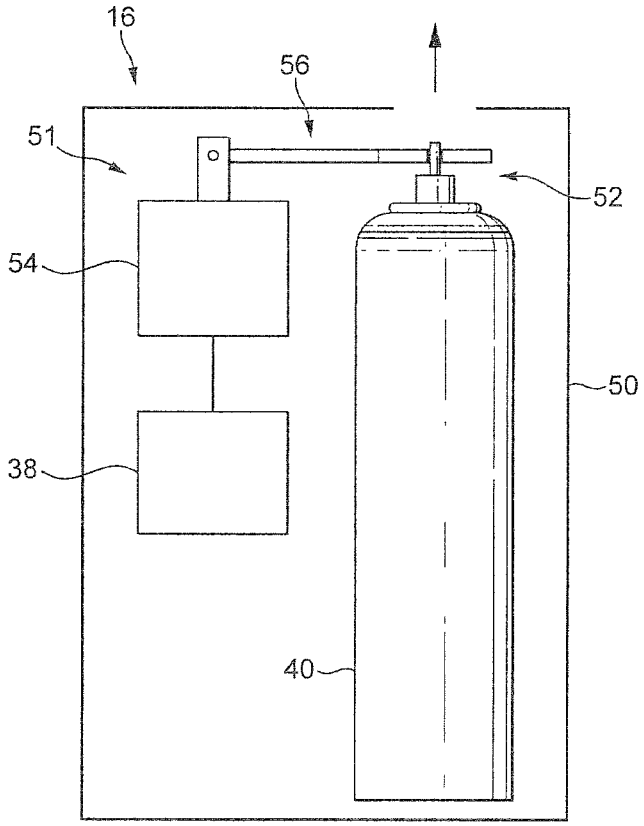
FIG. 3 is a schematic diagram of a dispensing device according to an embodiment of the present invention.

A dispensing device 16 is illustrated schematically in more detail in FIG. 3. The dispensing device 16 comprises a housing 50 in which a receiver 38 and a canister of fluid 40 are disposed. Also disposed within the housing is an actuating mechanism 51 which actuates a spray head 52 of the canister 40 on reception of a signal from the central controller. The actuating mechanism 51 may comprise an electromechanical device 54, such as a solenoid, and a linkage 56 to the spray head 52 such that when a signal from the central controller is received, the actuating mechanism 51 opens the spray head 52 in order to dispense fluid from the canister 40. The actuating mechanism 51 may then close the spray head after a certain period of time or on reception of a further signal from the central controller. An opening in the housing 50 is provided opposite the spray head 52 through which fluid is dispensed in the direction indicated by the arrow in FIG. 3. The receiver 38 may be configured to receive signals wirelessly from the central controller or the receiver 38 may comprise wiring for receiving a signal through a wire from the central controller.

Operation of the aforementioned security system will now be described.

When an intruder enters the building by forcing a door or a window, the detector associated with the point of entry detects the intruder and sends a signal to the controller. For example, with reference to FIG. 2, if an intruder enters at point A, the detecting unit 36A detects the intruder and a signal 42A is transmitted by the transmitting unit 34A to the central controller 12. Similarly, if an intruder enters at point B, the detecting unit 36B detects the intruder and a signal 42B is transmitted by the transmitting unit 34B to the central controller 12. The central controller 12 receives the signal at receiver 30, the processor 28 processes the received signal in order to determine which of the detectors has sent the signal, and then the transmitter 32 sends a signal to the appropriate dispensing device 40A, 40B actuating the dispensing device to dispense fluid in order to deter the intruder and/or identify the intruder.

If a plurality of intruders attempt entry from numerous entry points then the controller will receive signals from each of the detectors associated with the plurality of entry points and send signals to the associated dispensing devices such that a fluid is dispensed at each of the locations where intruders are attempting to gain entry. Furthermore, if the one or more intruders are not deterred from entry into the building by these measures, then a more powerful deterrent fluid may be utilised at, for example, the location of the safe 10 illustrated in FIG. 1 using a chemical irritant or the like in order to further deter an intruder.

The central controller can be programmed in order to determine which detectors/dispensing devices are activated for detection and dispensing. The central controller can also be programmed to define the duration of dispensing. For example, the central controller may be programmed in order to send a signal to some of the dispensing units in order to dispense for an amount of time specified by a user. The controller may be programmed to signal a dispensing unit to dispense a single burst of fluid or repetitive bursts based on signals received from the detectors. A plurality of different fluids may be provided within each of the dispensing device and the controller may be programmed to dispense different ones of the fluids. For example, the controller may be programmed to signal a dispensing device to dispense a deterrent fluid such as chemical irritant and then if the detector still detects the intruder then the controller may signal the dispensing unit to dispense an identifier such that the intruder may be identified at a later date. As the identifier fluid may be rather expensive, then this will prevent use of the more expensive fluid when an intruder is already deterred from entry. The controller may be further programmed in order to provide different signals to different dispensing devices. For example, a controller may be programmed to signal a dispensing device in the vicinity of a safe to dispense a long and continuous burst of fluid in order to prevent an intruder from working on opening the safe.

According to one embodiment, the controller is pre-programmed by the manufacturer. Alternatively, controller may be provided with a user interface configured to allow a user or installer of the system to program the controller.

The fluid may be gaseous or a liquid, preferably a liquid aerosol. Many different deterrent and/or identifier formulations for use in the present invention are known in the art. However, the present applicant has found that a particularly useful formulation comprises a DNA marker/identifier, a UV tracer/fluorescent material, a propellant, and optionally a solvent which may be organic, e.g. an alcohol, or aqueous.

Embodiments of the present invention provide very flexible fluid dispensing security systems which can be programmed and controlled from one location and are ideally suited for buildings having multiple points of entry.

Whilst this invention has been particularly shown and described with reference to preferred embodiments, it will be understood to those skilled in the art that various changes in form and detail may be made without departing from the scope of the invention as defined by the appended claims.

The invention claimed is:

1. A security system for dispensing an identifier such that an intruder may be identified at a later date, the system comprising:

a controller comprising a processor, at least one receiver, and at least one transmitter;

a plurality of dispensing devices; and a plurality of remote detectors, wherein the at least one receiver is adapted to receive signals from the plurality of remote detectors, the at least one transmitter is adapted to transmit signals to the plurality of dispensing devices, and the processor is adapted to identify which of the remote detectors has sent a signal to the controller and select a dispensing device which is associated with the identified detector in order to signal the appropriate dispensing device to dispense fluid; and wherein each dispensing device is configured to receive signals from the controller and dispense fluid when a signal is received, wherein the fluid comprises the identifier, and wherein the controller is adapted to indicate to the dispensing devices a duration for dispensing fluid.

2. A security system according to claim 1, wherein the controller is configured to receive signals from a first plurality of detectors and a second plurality of detectors, wherein when a signal is received from one or more of the first plurality of detectors, the controller arms the system, and when a signal is received from one or more of the second plurality of detectors, the controller determines which of the second plurality of detectors has transmitted the signal and transmits a signal to one or more of the dispensing devices to dispense a fluid based on said determination.

3. A security system according to claim 1 or 2, wherein the controller comprises a user interface configured to allow a user to program the processor.

4. A security system according to claim 1 or 2, wherein the controller is adapted to select one or more of the plurality of detectors and/or dispensing devices for activation or deactivation.

5. A security system according to claim 1 or 2, wherein the controller is adapted to indicate different length bursts of the fluid for different ones of the dispensing devices.

6. A security system according to claim 1 or 2, wherein the controller is adapted to indicate to the dispensing devices a type of fluid to be dispensed.

7. A security system according to claim 1 or 2, wherein the controller is adapted to send different control signals to different ones of the plurality of dispensing devices.

8. A security system according to claim 1 or 2, wherein the controller is adapted to send control signals to the dispensing devices for pulsed dispensing of fluid.

9. A security system according to claim 1 or 2, wherein the controller is adapted to indicate repetitive bursts for dispensing the fluid based on signals received from the detectors.

* * * * *